United States Patent [19]

Stadler et al.

[11] 4,362,563

[45] Dec. 7, 1982

[54] PROCESS FOR THE PRODUCTION OF METALLIC FORMED MEMBERS

[75] Inventors: Jörg Stadler, Rückersdorf; Max Rentzsch, Schnaittach; Siegfried Rhau, Nuremberg, all of Fed. Rep. of Germany

[73] Assignee: Diehl GmbH & Co., Nuremberg, Fed. Rep. of Germany

[21] Appl. No.: 95,530

[22] Filed: Nov. 19, 1979

[30] Foreign Application Priority Data

Dec. 6, 1978 [DE] Fed. Rep. of Germany ..... 2852659

[51] Int. Cl.[3] ..... F42B 13/48

[52] U.S. Cl. ..... 419/5; 29/1.2; 29/1.23; 102/491

[58] Field of Search ..... 29/1.2, 1.23; 75/208 R; 102/67; 428/554

[56] References Cited

U.S. PATENT DOCUMENTS

| | | | |
|---|---|---|---|
| 3,626,564 | 12/1971 | Daniel | 75/208 R |
| 3,834,003 | 9/1974 | Nayar | 75/208 R |
| 3,982,904 | 9/1976 | Nayar | 75/208 R |

FOREIGN PATENT DOCUMENTS

| | | | |
|---|---|---|---|
| 2129196 | 1/1973 | Fed. Rep. of Germany | 102/67 |
| 2310667 | 9/1974 | Fed. Rep. of Germany | 102/67 |
| 2557676 | 6/1977 | Fed. Rep. of Germany | 102/67 |

*Primary Examiner*—Brooks H. Hunt

*Attorney, Agent, or Firm*—Scully, Scott, Murphy & Presser

[57] ABSTRACT

A process for producing a formed member, and a formed member which includes spherical fragments embedded in a metallic matrix is effected through cold pressure rolling. The spheres are arranged in the interspace between a basic support member, which may be a thin-walled inner casing, and an outer casing. Forging of the outer casing causes the material of the support member and the outer casing to be pressed into the spaces between the spheres, densifies the support member and the outer casing, and prestresses the outer casing and spheres, thus allowing the inner casing to be extremely thin-walled. The prestressing of the spheres and outer casing, together with the inner casing imparts a high degree of energy to the casing fragments and to the spheres, affords economies in manufacture and a substantial increase in fragmenting energy at detonation of the formed member.

2 Claims, 3 Drawing Figures

PROCESS FOR THE PRODUCTION OF METALLIC FORMED MEMBERS

BACKGROUND OF THE INVENTION

1. Field of the Invention

The present invention relates to a process for the production of metallic formed members which include discrete particles embedded in a metallic matrix.

2. Description of the Prior Art

From the disclosure in German Patent Specification No. 24 60 013 there has become known a process for the production of formed or molded members which include discrete particles embedded in a metallic matrix. These particles are fastened to a metallic support and enveloped by a matrix which is constituted of a metallic powder. The support or carrier is isostatically pressed together with the particles and the enveloping material and thereafter sintered. The fragmentation bodies for projectiles which are produced pursuant to this process evidence a good fragmentation effect. However, the production of this fragmentation casing is complex from an economic standpoint since after the sintering, there will frequently be present unevenesses to the extent of a number of millimeters in the outer casing, which must be removed through a turning or machining operation. In order to be able to maintain the contemplated caliber size, the rough outer diameter of the fragmentation shell must, as a result, be selected of a relatively large size so as to be able to obviate that type of drawback. The extent of the machining on the fragmentation casing is thus relatively high. In addition thereto, the desired fragmentation effect cannot be reproduced in each instance since the matrix is forced at different depths into the interspaces between the particles during the pressing operation.

It is also disadvantageous that the sintering operation can adversely influence the metallurgical properties of the employed materials, such as the hardness or ductility. Moreover, the mentioned thermal process limits the number of materials which can be considered for the discrete particles.

Furthermore, from German Patent Specification No. 21 29 196 there has also become known a fragmentation body for fragmentation projectiles. Spherical fragments are filled in between two tubular members which are arranged within each other. Through high-pressure forming of the inner tubular member, the latter is pressed into the hollow inter-spaces between the fragments. Consequently, the tubular members are prefragmented and sandwiched together with the fragments into a fragmentation casing or shell. The high-pressure forming can be carried out in a shock-like manner, for example, through explosive shaping or electromagnetically, or also through pressing by means of a calibrating bolt.

A forming operation of that type is subject to the drawback in that, due to the degree of deformation which extends over too large a rolling width, the fragmentation effect is not reproducible to the required measure in that, because of the deformation force which cannot be uniformly distributed over the fragmentation casing, there will occur extremely high specific surface pressures which will fracture the spheres constituted, for instance, of hardened steel, such as ball bearing steel, and which will cause the deformation of the material of the inner casing beyond its ultimate tensile limits so as to cause a previously unpredictable reduction in the tensile strength. This reduction will also adversely affect the fragmentation effect.

SUMMARY OF THE INVENTION

Accordingly, it is an object of the present invention to provide a formed member for fragmentation projectiles which can be economically produced and which possesses a reproduceable fragmentation effect.

The foregoing object is inventively achieved for a formed member of the above-mentioned type in which the discrete particles are located between a metallic basic support member and a metallic outer casing, and wherein they are embedded into the support member as well as into the outer casing through cold pressure rolling of the outer casing, and in which the rollers in one or more passes will work the material of the outer casing and the metallic basic support member into the interspaces between the particles.

Through the invention there is thus advantageously achieved that, through the deformation of the outer casing, stresses will be produced in the outer casing which, in combination with the compressive stress in the spheres, will produce a significant increase in the fragmentation energy in the particles and in the outer casing fragments. The inner casing can thereby be extremely thin so that, upon detonation of the inserted explosive, the least possible energy must be expended for the deformation of the inner casing and the highest possible energy is transmitted through the fragmented inner casing to the particles. By means of the externally applied deformation force, through the outer casing and the particles, which are present in a form of spheres or balls, there is thus effected a deformation of the inner casing. This will effect a cold bonding in the region of the hemispherical identations formed by the spheres. The particles are thereby molded into the basic support member in a radial direction and therefore provide in these regions zones of higher hardness, and resultingly a higher tensile strength, between which there are narrow zones of lower tensile strength. The zones of lower tensile strength determine the fragmentation. Consequently, less energy is required for fragmentation then would be for an inner casing of a uniformly higher tensile strength. The volume of voids between the basic support member and the outer casing and the particles is minimized and, as a result, there is available a high mass and, in effect, a specialized mass of high density, as an energy carrier. Through the deformation there are present formed members which will be possessing a high dimensional precision and imbued with an excellent concentricity, meaning, the extent of any machining is extremely small and the static and dynamic imbalances significant with regard to accurate impact against a target are negligibly small. The discrete particles are reproduceably pressed against each other and will, in a defined manner, be shaped within the elastic range, or within the elastic range and within the plastic range. Hereby, the particles which are essential for the fragmentation of the outer casing will transmit the detonation energy completely within the range of their being molded into the outer casing since, in the same manner, there is present a zonal increase in the tensile strength as in the inner casing. The material of the outer and inner casings, pursuant to the caliber of the formed member, will encompass the particles up to about 70% of the particle surfaces and, as a result, during detonation the particles will be subjected to a relatively low specific surface pressure and will not be destroyed. Furthermore, the collective components of the formed member can be cold formed, for which a large number of materials are suitable for processing, even such as bonded materials. Through the cold forming the hardness of the discrete particles is not subjected to any changes inasmuch as no thermal loads are present. Notwithstanding the cold deformation of the discrete particles constituted of hardened steel, or heavy metal, surprisingly it is not absolutely necessary to have a spacing pattern since, due to the embedding of the spheres up to about 70% through a material of the inner and outer casing, there will not occur any fracturing of the particles during plastic deformation. However, contrastingly, for particles of hard metal it is necessary to provide a spacing pattern since that material is not plastically deformable.

The spacing pattern is absolutely necessary for spheres consisting of hard metal, since hard metal is not deformable. Hereby, the spacing pattern guarantees the desired embedding of the spheres into the material of the encompassing components, without that the hard metal spheres will be destroyed.

For spheres or balls of heavy metal, hardened steel or alloyed steel which are deformable within predetermined bounds, by means of the spacing it is possible to achieve a still better degree of embedding than without the spacing pattern. The spheres are first pressed against each other after the reaching of a predetermined degree of embedding. This will render it possible that, after the mutual contacting of the spheres or balls, the formed member may still be additionally deformed so as to attain a still higher degree of embedding.

In a further aspect of the invention, the cold pressure rolling is effected in that the formed member is shaped through passes in synchronized paths wherein the outer casing contacts a stop on the basic support member and, as viewed in the direction of deformation thereof, the basic support member behind the stop evidences an approximately finished diameter. This will provide a uniformly constant degree of filling of the interspaces between the particles with the material of the outer casing and in which the grain flow lines will be uninterrupted.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
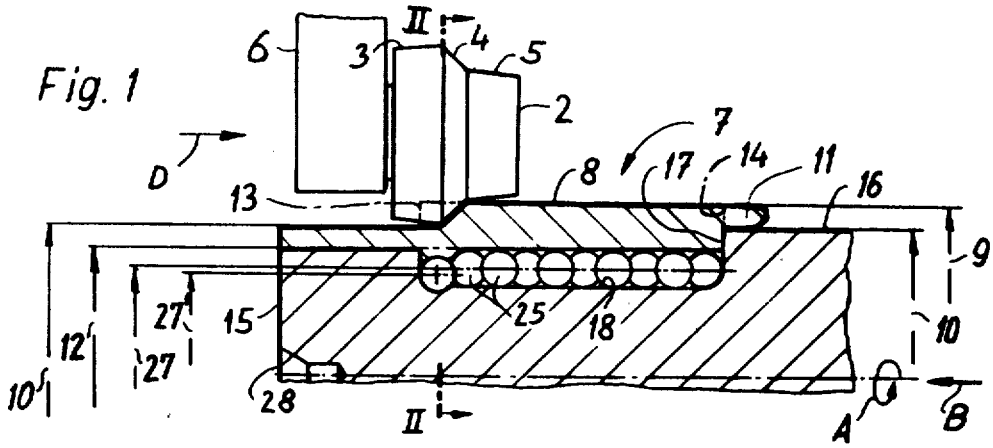
FIG. 1 generally schematically illustrates in section a portion of a formed member and an arrangement for pressure rolling.

With specific reference to the accompanying drawings, in the various figures the reference numeral 1 identifies a known arrangement for pressure rolling, 2 are rollers, 3 through 5 are conical surfaces, 6 is a pressing arrangement including a drive, 7 a formed member, 8 an outer casing, 9 a rough diameter, 10 a finished diameter, 11 a protuberance, 12 an inner diameter, 15 a basic support member, 16 a collar, 17 a stop, 18 a recess, 19 and 19' interspaces, 25 spheres, 26 a spacing pattern, 26' spacers, 27 initial part circle, 27' finished part circle, 28 a centering bore, and 29 a spacer.

The outer casing 8 is positioned against the surface of stop 17 of the basic support member 15. The outer casing 8 is provided with a step 13 prior to the cold deformation operation pursuant to the phantom lines illustrated in FIG. 1, and which ends at 14. The collar 16 evidences the finished diameter 10, as does the basic support member 15 commencing from the stop 17. The inner diameter 12 of the outer casing 8 is so dimensional that the outer casing 8 can be easily slid over the spheres 25 which are arranged separated through the the intermediary of the spacers 26' within the recess 18. The recess 18 possesses a radial depth corresponding to that of the diameters of spheres 25.

The basic support member 15 is inserted into a clamping head of the arrangement 1 in a manner not illustrated herein. Arranged oppositely thereto, a mandrel of the arrangement (not shown) engages into the centering bore 28 of the basic support member 15.

Figure 3:
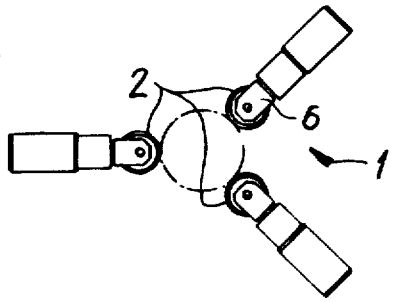
FIG. 3 illustrates an arrangement for pressure rolling.

The arrangement 1 for pressure rolling encompasses three rollers 2 with, schematically illustrated, a radical positioning device in conformance with the arrangement illustrated in FIG. 3.

Figure 2:
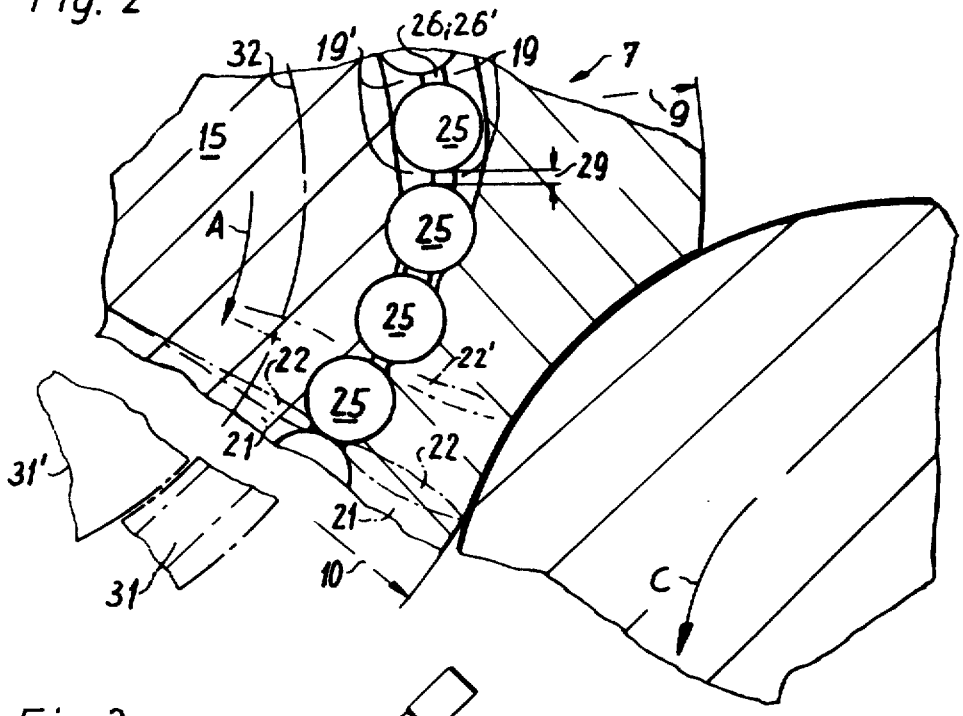
FIG. 2 is an enlarged fragmentary sectional view taken along line II—II in FIG. 1.

During the pressure rolling of the formed member 7 which is constituted of the outer casing 8, spheres 25 and the basic support member 15 or the inner casing 31 (FIG. 2), the positions of the three rollers 2 are adjusted to the finished diameter 10.

The formed members 7 which rotates in the direction of arrow A is continually moved between the rollers 2 in the direction of arrow B. Consequently, the rollers 2 which rotate in the direction of arrow C due to the formed member 7 will deform the outer casing 8 commencing from the step 13 up to the stop 17 as is shown in the FIG. 1 and 2. The material of the outer casing 8 is pressed into the interspaces 19 between the spheres 25. Hereby, the spheres 25 mold themselves into the material of the basic support member 15 so that this material is displaced into the interspaces 19'. Accordingly, the outer casing 8 will elongate itself during the pressing operation to the extent of the protuberance 11, which is illustrated herein only by way of example (FIG. 1). The protuberance 11 is sheared off at the stop 17 by the action of the rollers 2 running thereover. After the completion of the deformation, in order to obtain a formed member for utilization as a projectile fragment casing, the basic support member 15 is turned out up to the phantom-illustrated line 32.

By means of the pressure which is exerted upon the spheres 25, commencing from the initial part circle 27, these spheres are displaced so far in a radial direction into the basic support member 15 until the material of the basic support member 15 and the pressed together spheres 25 produce an equally large counterpressure. The spheres 25 are then located on the finished part circle 27' and are subjected to a compressive stress. This compressive stress subjects the outer casing 8 to a tensile stress.

The size of the spacing 29 (the thickness of the spacers 26' of the spacing pattern 26) is dependent upon the type of material being utilized for the basic support member 15 and the spheres 25. This spacing is to be so selected that, for the described single roll pass, there is achieved the mutual contacting of the spheres 25 and a desired compressive stress in the spheres without destruction of the latter. During the deformation the material of the spacers 26' is displaced sideways into the still remaining interspaces or voids.

The basic support member 15 or the inner casing 31 which is supportable through a mandrel 31', in accordance with the molding in of the spheres, possesses zones 21 of higher tensile strength and zones 22 of lower tensile strength. The same is true for the outer casing 8. Additionally, the outer casing 8 contains tensile stresses which are occasioned through the deformation of the spheres 25 within the elastic or the elastic and plastic range. The spheres 25 are compressed during the deformation operation and store a portion of their deformation energy (tensile stress). After the deformation the spheres 25 transfer a portion of the deformation energy to the outer casing 8 and, to a lesser extent, to their base support (inner casing 31 of basic support member 15). The deformation energy which is assumed by the mentioned components generates correspondingly large tensile stresses in these components. The tensile stresses are larger in the outer casing 8 than in the basic support member 15 or the inner casing 31. The zone which is only identified by 22' is still incomplete since the deformation operation has not yet been completed.

In addition to a single roll pass it also possible to undertake a plurality of passes when the material does not allow for the desired reduction in wall thickness during a single pass.

In lieu of the basic support member 15 which is constituted of solid material there can also be utilized a hollow sleeve or casing 31. This is carried or radially supported by a mandrel (not shown) of the arrangement. After the deformation, this mandrel is removed from the formed member.

In the described pressure rolling, the deformation is effected in a helically-shaped manner. In contrast therewith, it is also possible to effect a deformation pursuant to the annular contact process in which the formed member is not moved continually in an axial direction, but exerts axial displacements.

What is claimed is:

1. In a process for the production of formed member, including discrete particles embedded in a metallic matrix, the improvement comprising: arranging said particles intermediate a metallic basic support member and a metallic outer casing; embedding said particles in said basic support member and said outer casing through cold pressure rolling of said outer casing; and having pressure rollers work the material of the outer casing and the metallic basic support member during at least one roll pass into the interspaces between said particles.

2. A process as claimed in claim 1, comprising deforming said formed member through roll passes in synchronized paths wherein the outer casing contacts a stop of said basic support member and, in the direction of deformation, said basic support member has an approximate finished diameter after said stop.

* * * * *